US010596058B2

(12) United States Patent
Kose et al.

(10) Patent No.: US 10,596,058 B2
(45) Date of Patent: Mar. 24, 2020

(54) LOCOMOTION THERAPY AND REHABILITATION DEVICE

(71) Applicants: Kemal Cem Kose, Kutahya (TR); Ferzende Tekce, Kutahya (TR); Hasan Sahin, Istanbul (TR)

(72) Inventors: Kemal Cem Kose, Kutahya (TR); Ferzende Tekce, Kutahya (TR); Hasan Sahin, Istanbul (TR); Mehmet Senel, Kutahya (TR)

(73) Assignees: Kemal Cem Kose, Kutahya (TR); Ferzende Tekce, Kutahya (TR); Hasan Sahin, Istanbul (TR)

( * ) Notice: Subject to any disclaimer, the term of this patent is extended or adjusted under 35 U.S.C. 154(b) by 423 days.

(21) Appl. No.: 15/507,741

(22) PCT Filed: Aug. 13, 2015

(86) PCT No.: PCT/TR2015/050067
§ 371 (c)(1),
(2) Date: Feb. 28, 2017

(87) PCT Pub. No.: WO2016/032413
PCT Pub. Date: Mar. 3, 2016

(65) Prior Publication Data

US 2017/0290728 A1 Oct. 12, 2017

(30) Foreign Application Priority Data

Aug. 28, 2014 (TR) ..... 2014/10105

(51) Int. Cl.
*A61H 3/00* (2006.01)
*A61H 1/02* (2006.01)
(Continued)

(52) U.S. Cl.
CPC ..... *A61H 1/0237* (2013.01); *A61H 1/024* (2013.01); *A61H 1/0244* (2013.01);
(Continued)

(58) Field of Classification Search
CPC . A61H 3/00; A61H 3/008; A61H 1/00; A61H 1/024; A61H 1/0244; A61H 1/0266;
(Continued)

(56) References Cited

U.S. PATENT DOCUMENTS 4,569,352 A * 2/1986 Petrofsky ..... A61N 1/36003 607/49
6,821,233 B1 11/2004 Colombo et al.
(Continued)

FOREIGN PATENT DOCUMENTS

CN 103961240 A 8/2014
KR 20040072197 A 8/2004
(Continued)

OTHER PUBLICATIONS

Yoon Jeong Won, "Design and Control of a Reconfigurable Virtual Walking Machine and Its Applications to Locomotion Interface and Lower", Gwandiju Institute of Science and Technology, 2005, 124p, Advisor: Prof. Jeha Ryu.

*Primary Examiner* — Michael J Tsai
*Assistant Examiner* — Matthew Standard
(74) *Attorney, Agent, or Firm* — Bayramoglu Law Offices LLC

(57) ABSTRACT

The invention according to the application relates to a locomotion therapy and rehabilitation device developed for patients whose locomotion function is either lost or declined due to spinal disorders, orthopaedic surgeries and central nervous system disorders to redevelop and improve their walking ability.

33 Claims, 17 Drawing Sheets

(51) Int. Cl.

| | |
|---|---|
| ***A63B 69/00*** | (2006.01) |
| ***A63B 21/005*** | (2006.01) |
| ***A63B 22/00*** | (2006.01) |
| ***A63B 22/06*** | (2006.01) |
| ***A63B 21/00*** | (2006.01) |

(52) U.S. Cl.
CPC ..... *A61H 1/0266* (2013.01); *A63B 21/0058* (2013.01); *A63B 21/00178* (2013.01); *A63B 21/00181* (2013.01); *A63B 22/0056* (2013.01); *A63B 22/0664* (2013.01); *A63B 69/0064* (2013.01); *A61H 3/008* (2013.01); *A61H 2201/1215* (2013.01); *A61H 2201/164* (2013.01); *A61H 2201/1616* (2013.01); *A61H 2201/1652* (2013.01); *A63B 21/4005* (2015.10); *A63B 2022/0038* (2013.01); *A63B 2022/0094* (2013.01); *A63B 2022/0688* (2013.01)

(58) Field of Classification Search
CPC ..... A61H 1/0262; A61H 1/02; A61H 1/0229; A61H 2203/007; A61H 2203/0481–0487; A63B 21/00; A63B 21/00178
See application file for complete search history.

(56) References Cited

U.S. PATENT DOCUMENTS

| | | | | |
|---|---|---|---|---|
| 7,163,492 | B1 | 1/2007 | Sotiriades | |
| 2005/0239613 | A1 | 10/2005 | Colombo et al. | |
| 2008/0234113 | A1* | 9/2008 | Einav | A61B 5/103 482/66 |
| 2008/0249438 | A1* | 10/2008 | Agrawal | A61H 1/0237 601/35 |
| 2014/0087922 | A1 | 3/2014 | Bayerlein et al. | |
| 2014/0100491 | A1* | 4/2014 | Hu | A61H 3/008 601/27 |

FOREIGN PATENT DOCUMENTS

| | | | |
|---|---|---|---|
| WO | WO2010105773 | A1 | 9/2010 |
| WO | WO2010136160 | A1 | 12/2010 |
| WO | WO2012137038 | A1 | 10/2012 |

* cited by examiner

LOCOMOTION THERAPY AND REHABILITATION DEVICE

CROSS REFERENCE TO RELATED APPLICATIONS

This application is the national phase entry of International Application No. PCT/TR2015/050067, filed on Aug. 13, 2015, which is based upon and claims priority to Turkish Patent Application No. 2014/10105 filed on Aug. 28, 2014, the entire contents of which are incorporated herein by reference.

TECHNICAL FIELD

The invention according to the application relates to a locomotion therapy and rehabilitation device developed for patients whose locomotion function is either lost or declined due to spinal disorders, orthopaedic surgeries and central nervous system disorders to redevelop and improve their walking ability.

BACKGROUND

In the state-of-the-art there are several devices developed for patients whose locomotion function is either lost or declined due to spinal disorders, orthopaedic surgeries and central nervous system disorders to redevelop and improve their walking ability.

The basic operation of these devices which are generally called walkers or walking aids is designed to relieve the patient of a significant part of body weight by means of various sling mechanisms and thereby allow the patient to receive rehabilitation treatment by performing only walking and foot movement exercises for extended periods.

However, in these devices, parts that provide the basic advantage for the patient to regain locomotion function are not the sling mechanisms which reduce body weight but stepping mechanisms which allow foot and walking movements.

The closer the movement model achieved by the stepping mechanism is closer to the natural walking motion, the easier the brain refocuses on the learnt walking movement and the motor nervous system repeats the same movements. For this reason, the main motive behind the development of these devices is to achieve a movement model that is closest to the natural walking movement.

Some of the prior art devices are based on treadmills, wherein the patient's weight is carried by extra equipment and leg and foot movements are coordinated externally for proper walking exercises. The invention disclosed in the U.S. Pat. No. 6,821,233B1 numbered U.S. Patent is an example of this type of devices. The most important technical problem related to the devices that depend on a treadmill is that the device does not provide any assistance in adapting patient's stepping movements to the natural movement.

The invention disclosed in the US2005239613A1 numbered U.S. Patent Application may be provided as an example for mechanisms which are currently used in numerous walkers and intended for supporting patients by carrying their weight. The said application discloses how the patient's weight is supported, while no information is present regarding walking therapy.

Another prior art device belongs to Jungwon Yoon (YOON JEONG WON) and is disclosed in "Machine and Its Applications to Locomotion Interface and Lower Limb Rehabilitation, Gwangju Institute of Science and Technology, 2005, 124p, Advisor: Prof. Jeha Ryu" and the KR20040072197A numbered Korean Patent Application.

In the invention according to the said patent application, walking movement is simulated by vertical lifting elements that support forefoot and hindfoot's vertical movement. In order to fully simulate walking movement, one of the vertical lifting elements which provide mechanism's front and rear vertical movement should have joint freedom. An angle $\alpha$ is present between Position 1 and Position 2 as seen in FIG. 21. Since this angle vary depending on the patient's weight and forces it exerts, the elliptical orbit formed by forefoot and hindfoot during walking movement cannot be fully simulated.

In the invention according to the present application formation of an angle $\alpha$ such as in the Jungwon Yoon invention is avoided and the motion curve formed by the foot during walking is simulated in such a manner that it is controlled and close to actual walking movement.

SUMMARY OF THE INVENTION

The locomotion therapy and rehabilitation device according to the invention basically consists of an upper body (53), a weight balancing module (54), a sling and carrying system (55), 2 independent leg support mechanisms (52), 2 independent robotic walking mechanisms (56) and a horizontal base (51) on which these walking mechanisms operate.

The height of the upper body (53) is designed in such a manner that it is higher than the sum of the horizontal base's (51) and the patient's heights and it is intended to carry the patient by slinging in order to support a portion of patient's weight.

The following has been aimed in the development of the locomotion therapy and rehabilitation device according to the invention:

- Obtaining a locomotion therapy and rehabilitation device that can fully simulate natural walking motion and characteristic and teach it to the patient,
- Obtaining the vertical movement, that is the natural oscillation performed by the patient during walking, in an upright position and without losing balance in the forward-backward direction,
- Obtaining a device for automatically measuring and controllably reducing patient's weight by means of the weight balancing mechanism and fixing the said reduction dynamically at a certain value during walking,
- Obtaining a single size locomotion therapy and rehabilitation device that is adaptable to adult and paediatric patients of various height and sizes,
- Obtaining a robotic walking mechanism, wherein there is no angle formed between forward and backward tilted positions of the vertical lifting elements which allows the mechanism to move vertical movement in the front and the back in order to fully simulate walking motion,
- Obtaining a robotic walking mechanism with a foot support base that can be lowered or raised in order to adapt to patient's leg length in cases where one leg is shorter than the other,
- Developing a robotic walking mechanism, wherein, in patients with legs of different strength, each leg's movement is measured separately and rehabilitated individually.

BRIEF DESCRIPTION OF THE DRAWINGS

The figures used for a better explanation of the locomotion therapy and rehabilitation device developed with this invention are explained below.

Figure 1:
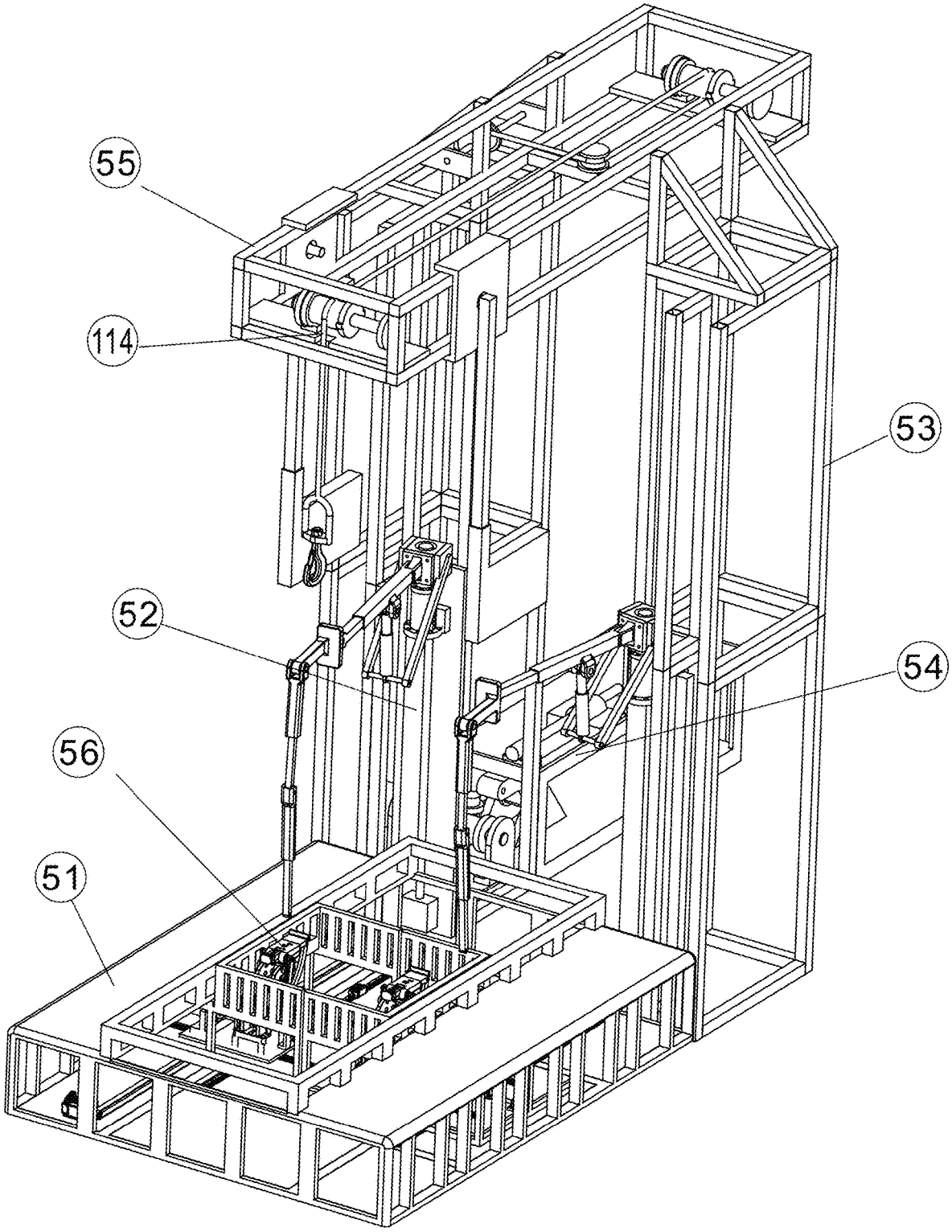
FIG. 1—A general view of the locomotion therapy and rehabilitation device according to the invention.
Figure 2:
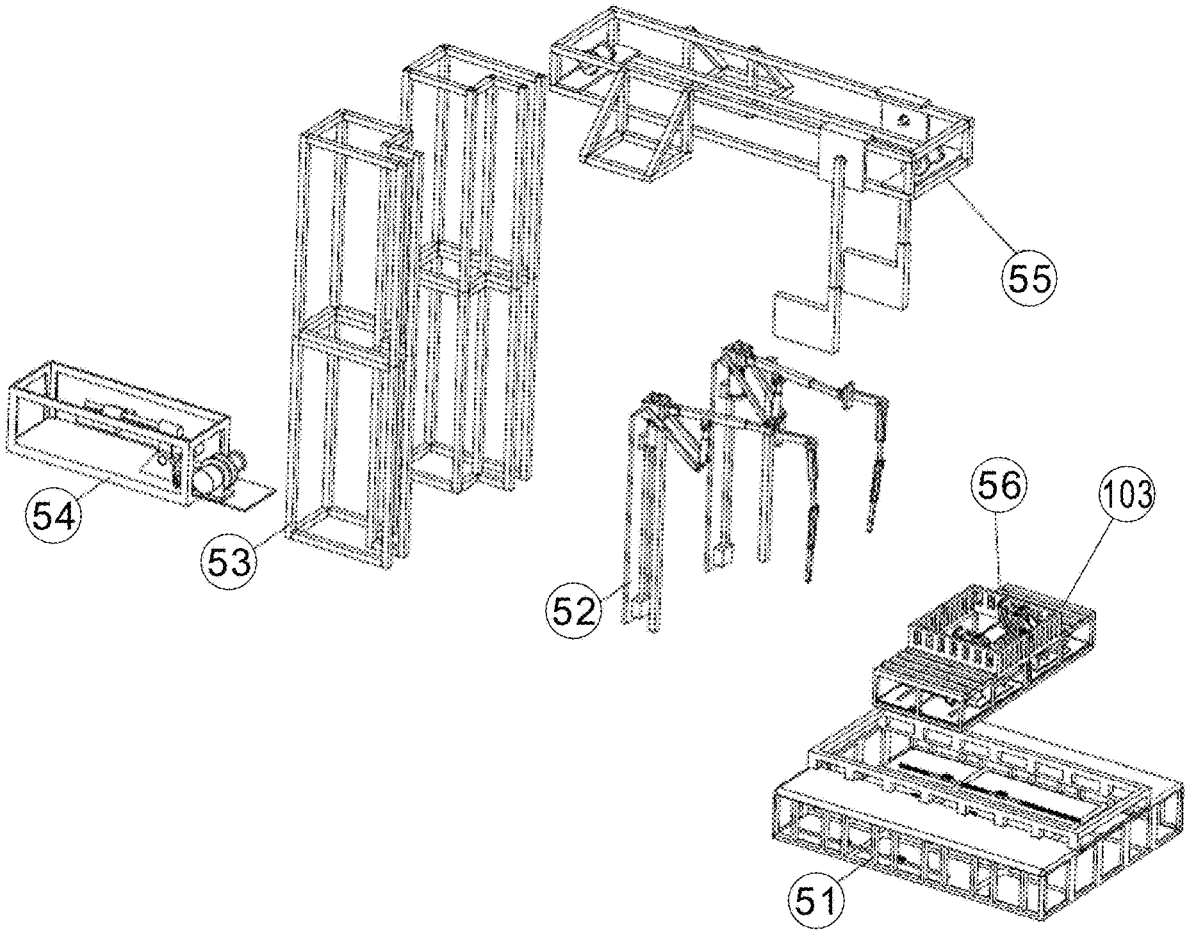
FIG. 2—An exploded view of the locomotion therapy and rehabilitation device according to the invention.
Figure 3:
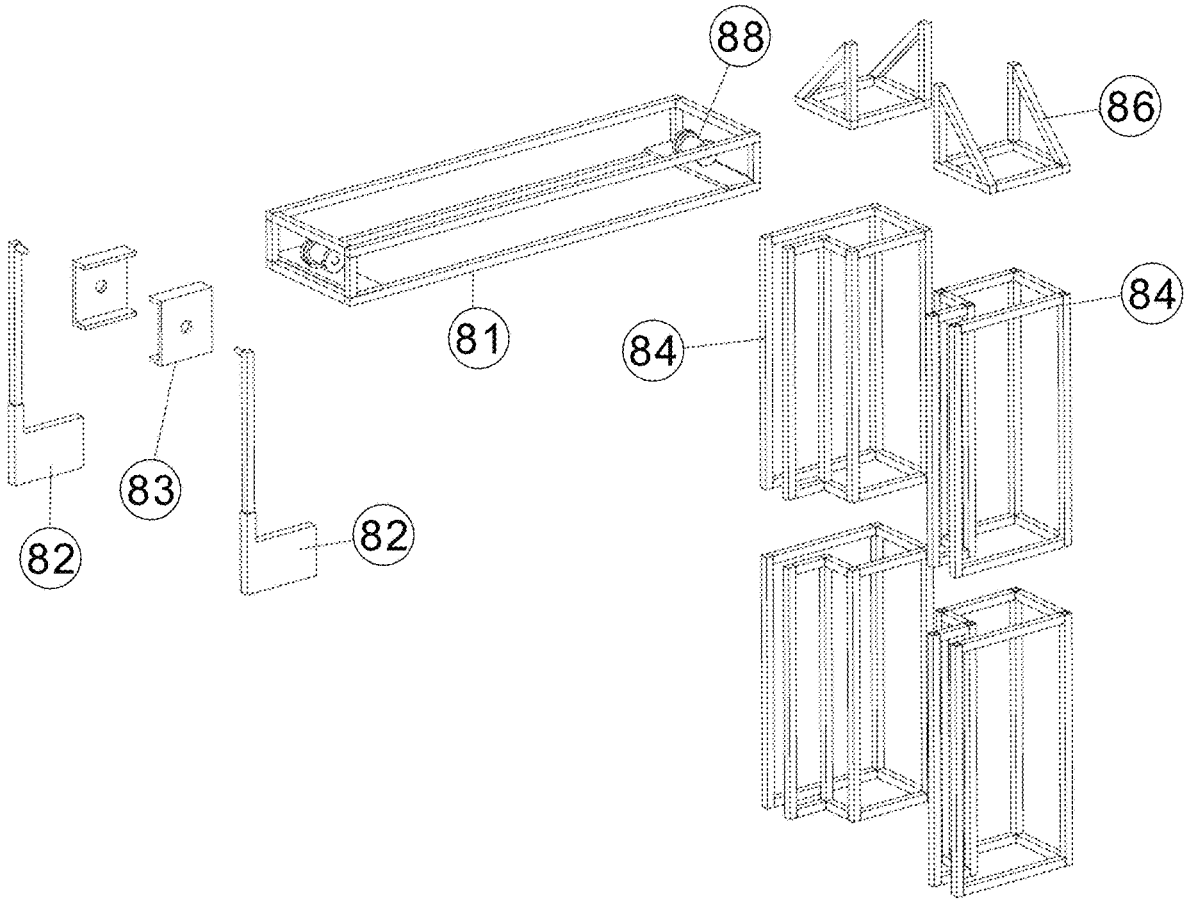
FIG. 3—An exploded view of the upper body of the locomotion therapy and rehabilitation device according to the invention.
Figure 4:
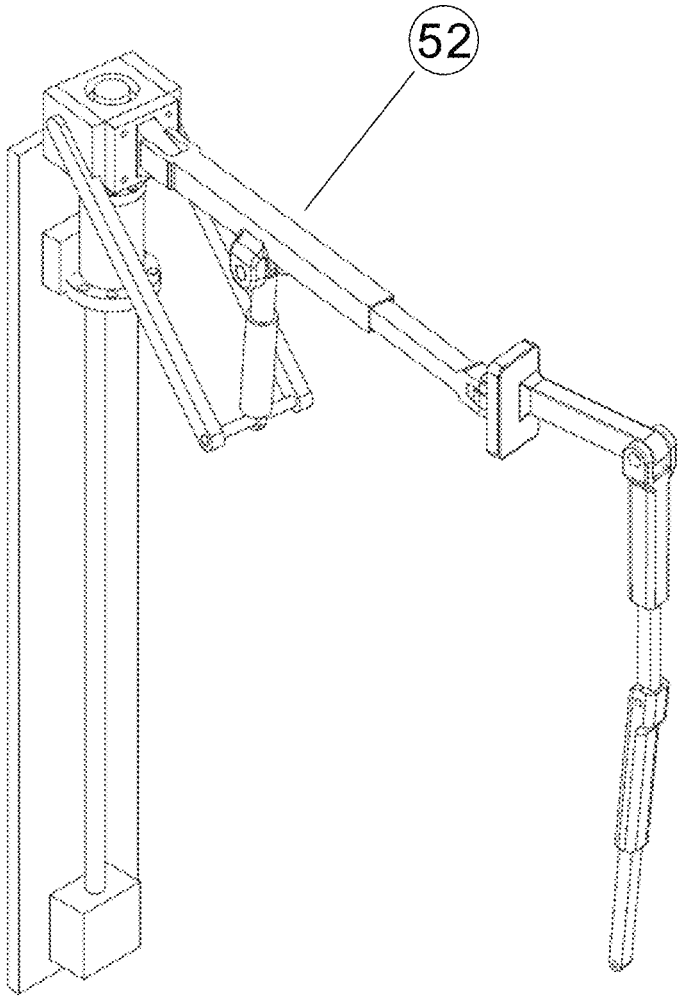
FIG. 4—A general view of the leg support mechanism.
Figure 5:
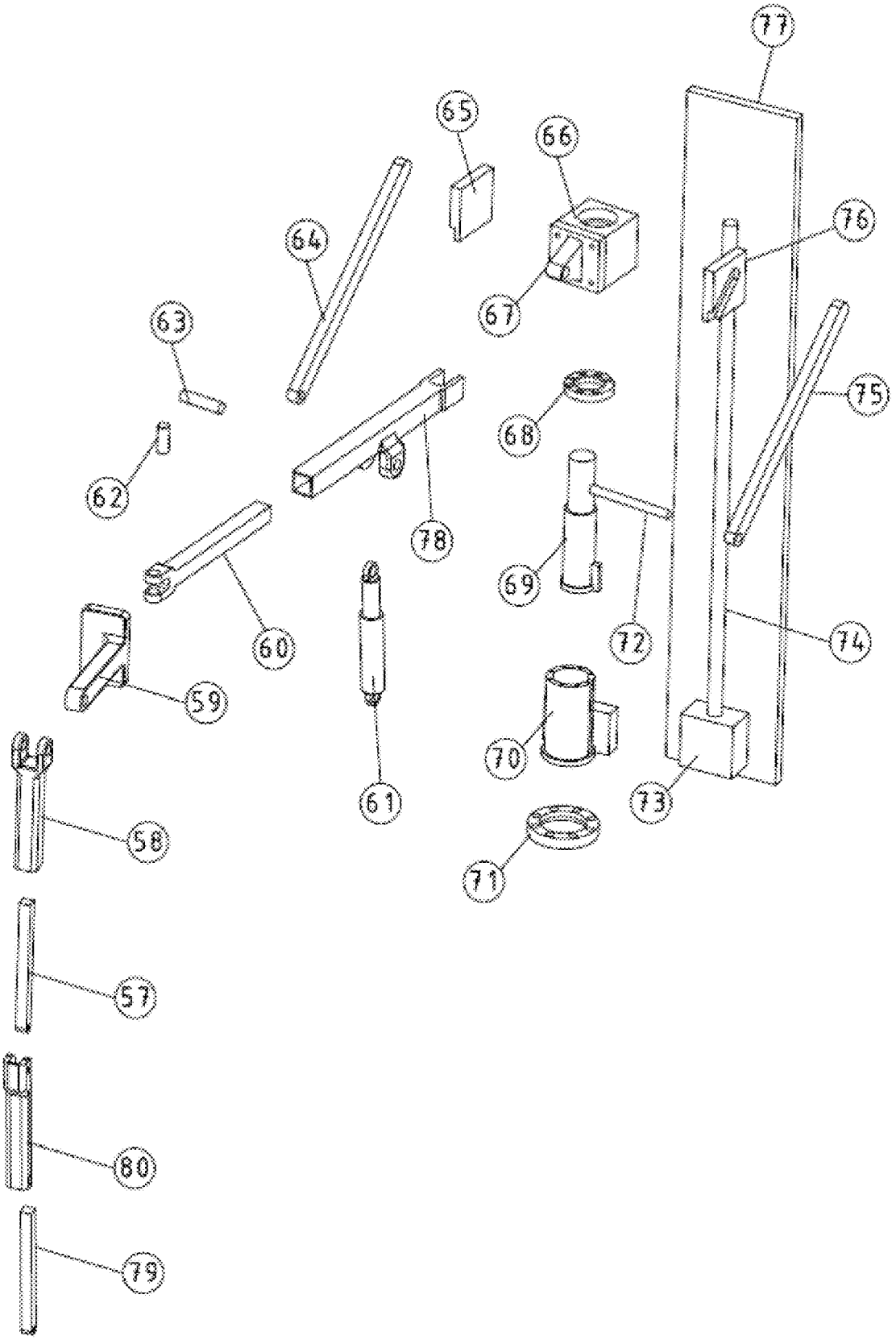
FIG. 5—An exploded view of the leg support mechanism.
Figure 6:
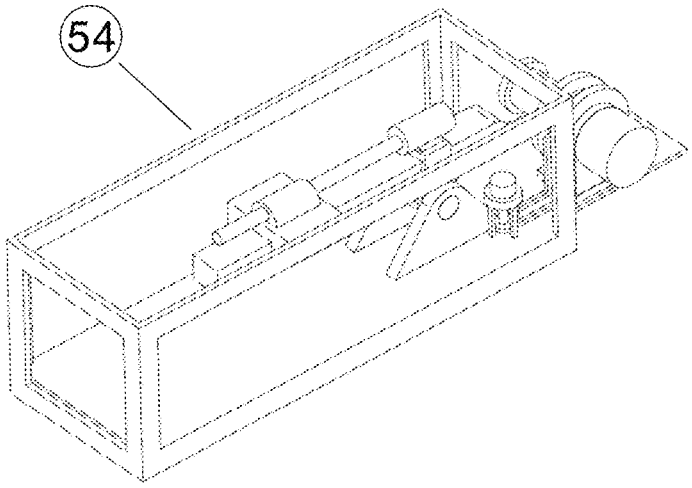
FIG. 6—A general view of the weight balancing module.
Figure 7:
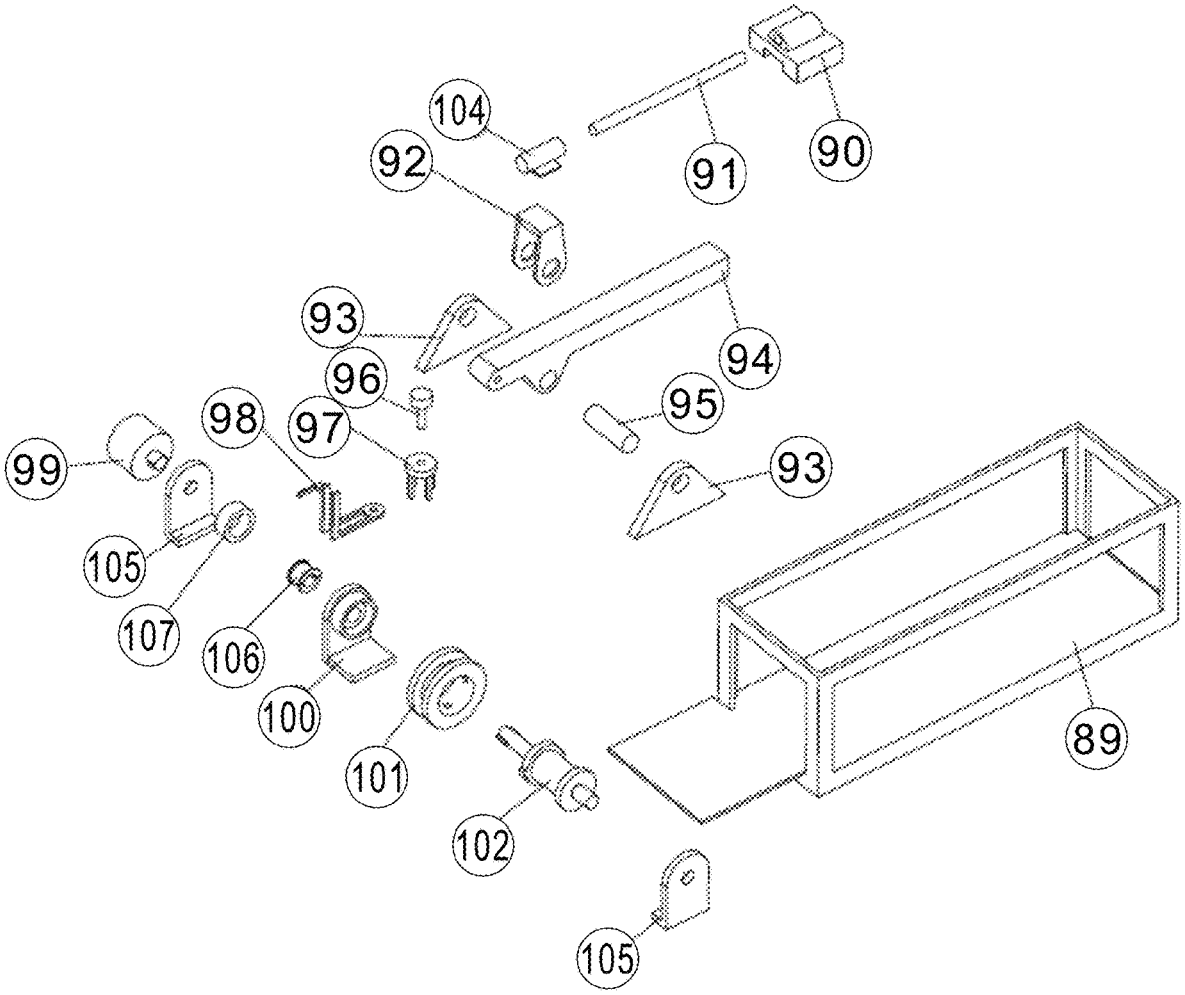
FIG. 7—An exploded view of the weight balancing module.
Figure 8:
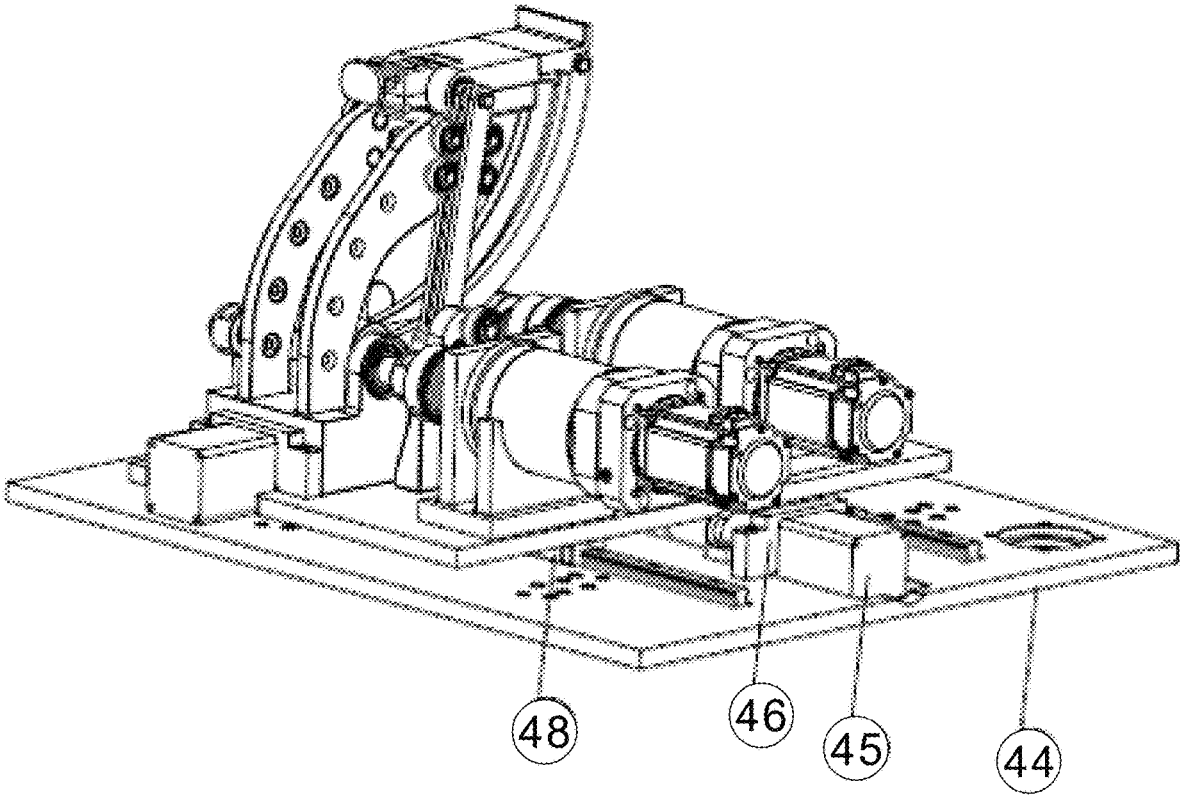
FIG. 8—A general view of the robotic walking mechanism.
Figure 9:
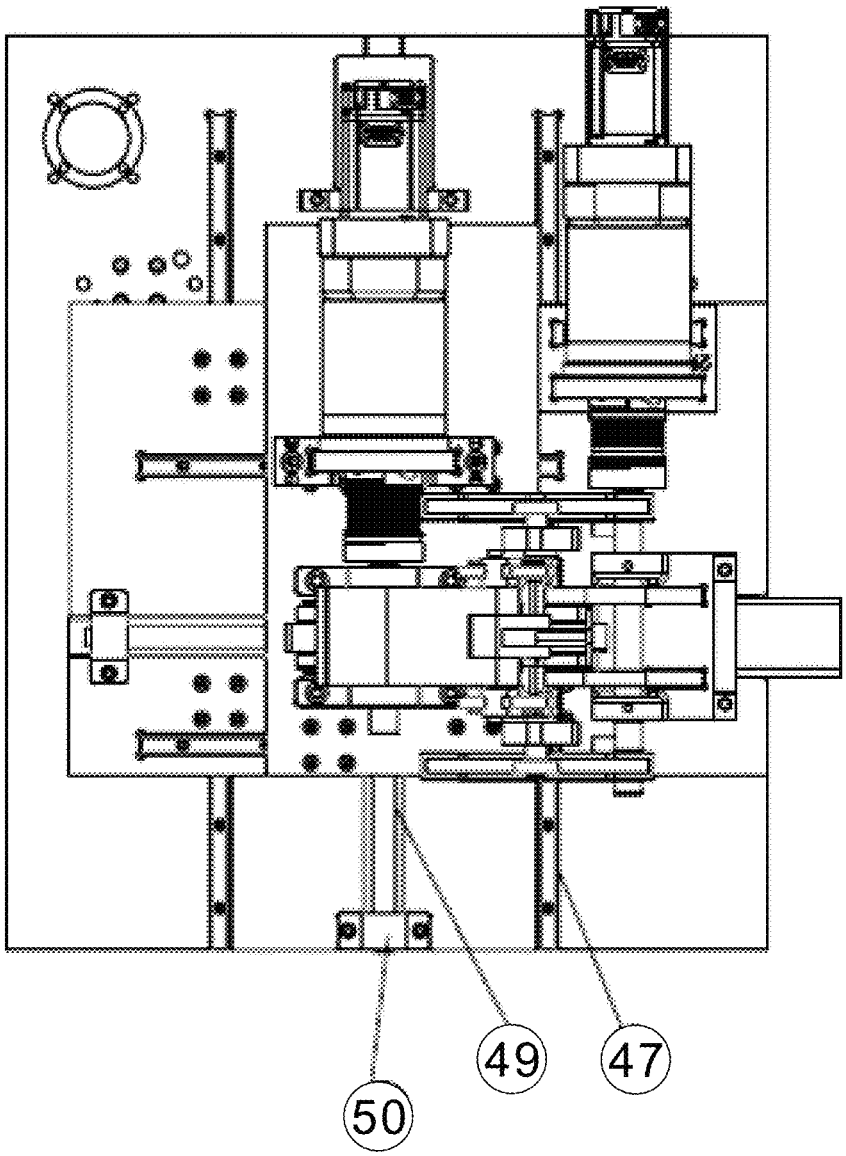
FIG. 9—A top view of the robotic walking mechanism.
Figure 10:
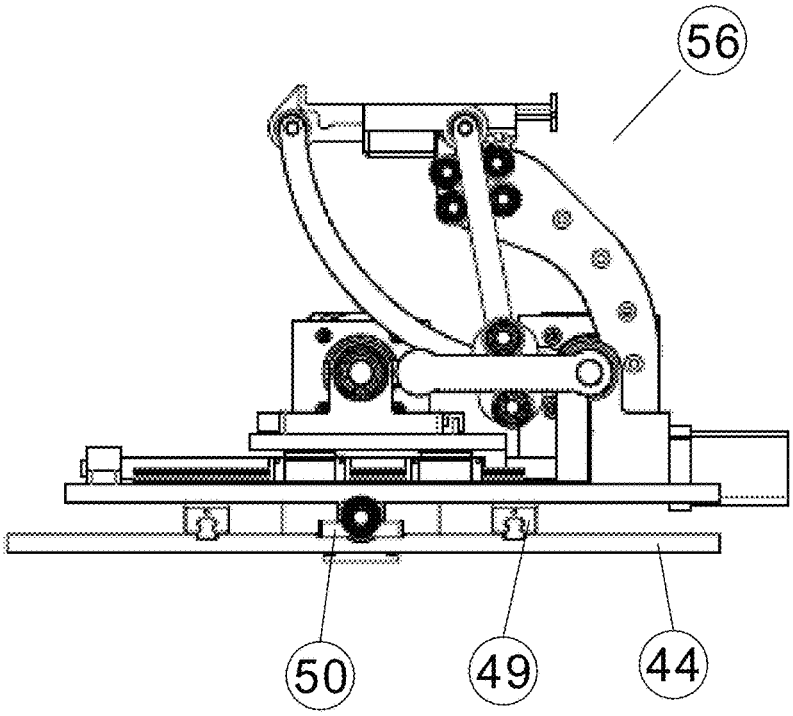
FIG. 10—A side view of the robotic walking mechanism.
Figure 11:
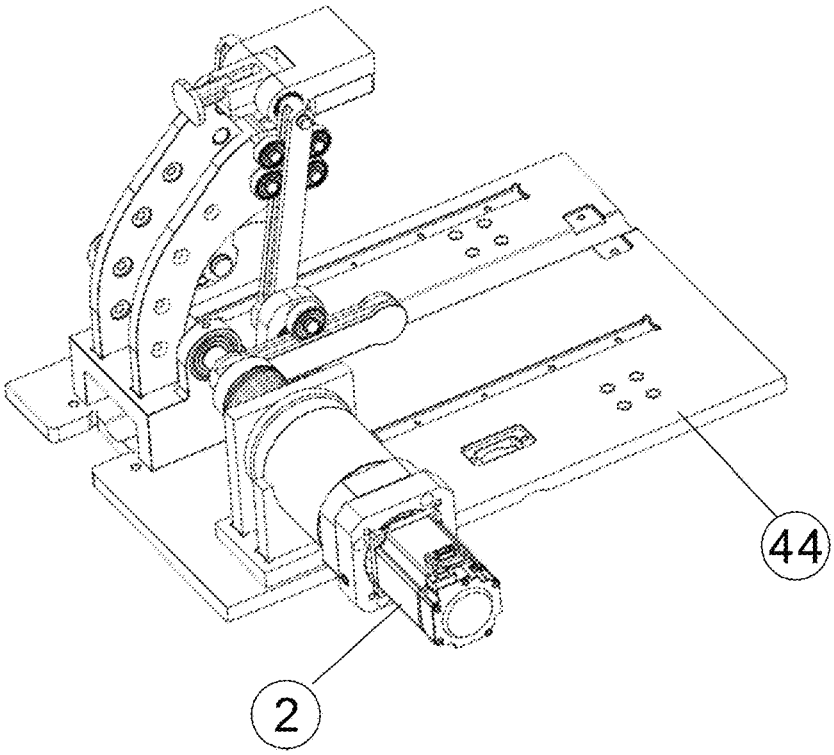
FIG. 11—A general view of the forefoot lifting module of the robotic walking mechanism.
Figure 12:
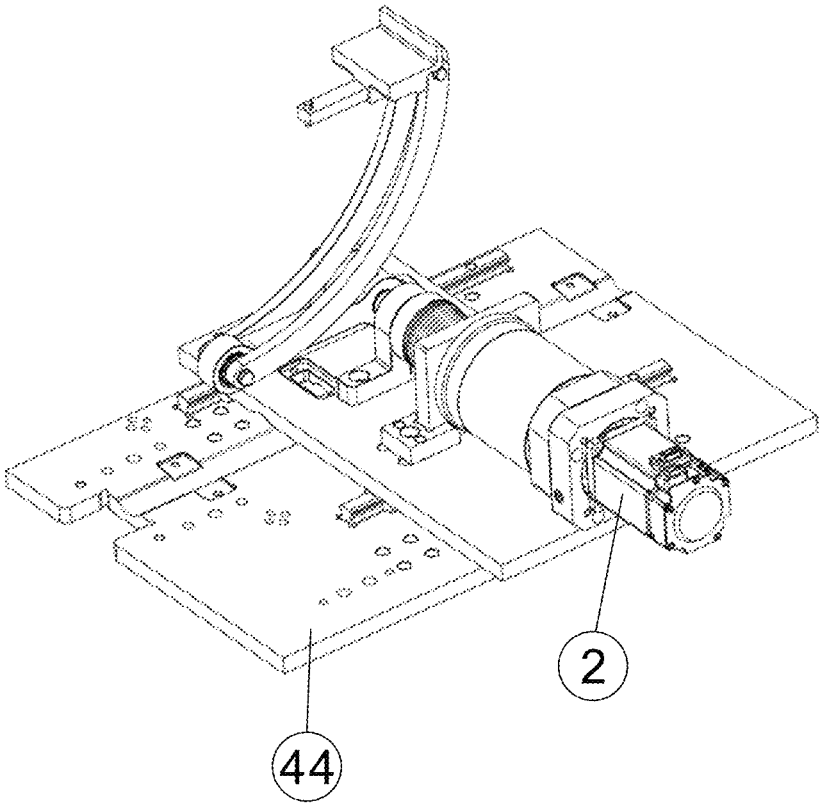
FIG. 12—A general view of the heel lifting module of the robotic walking mechanism.
Figure 13:
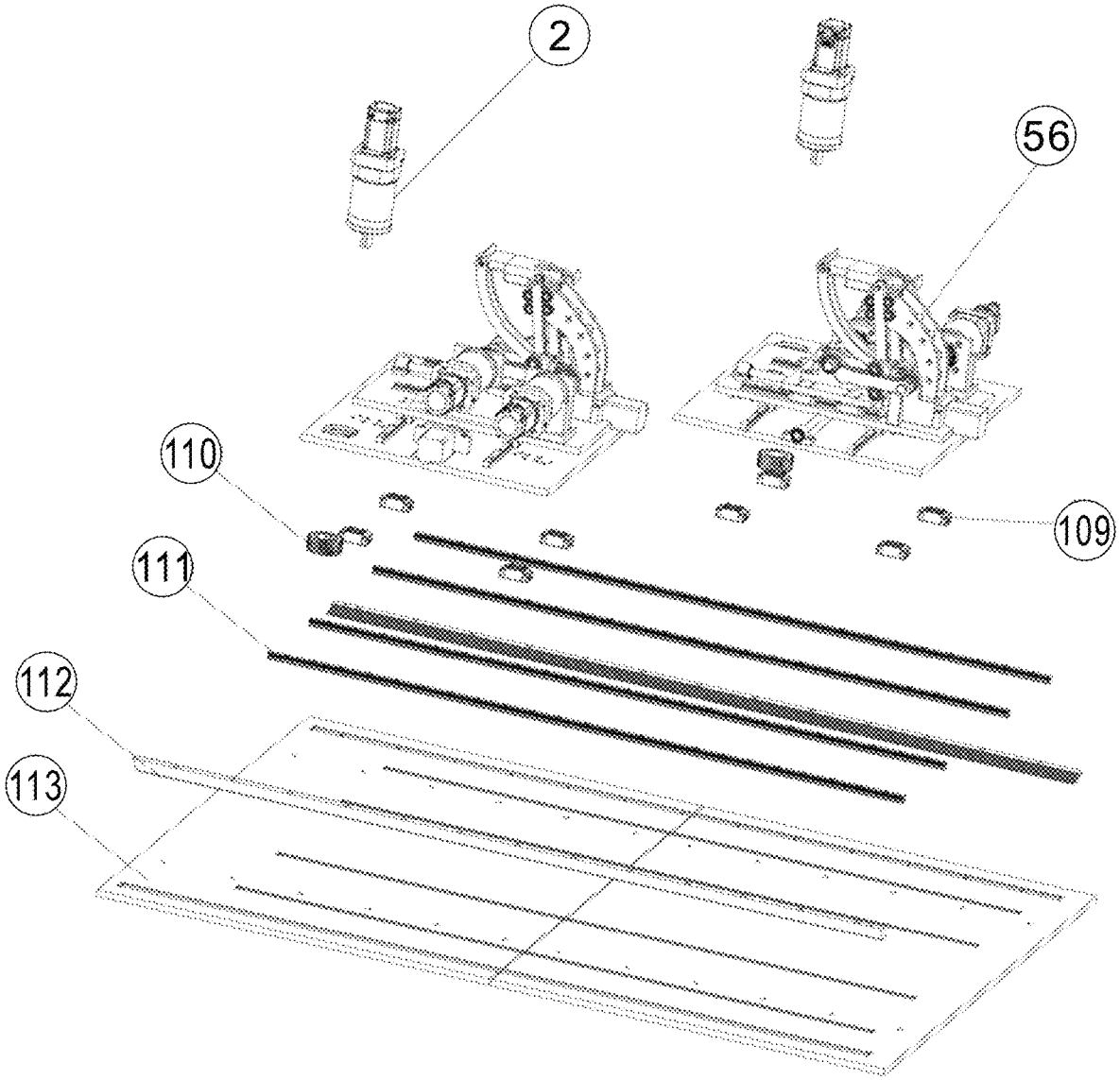
FIG. 13—An exploded view of the robotic walking mechanism and the carrying module.
Figure 14:
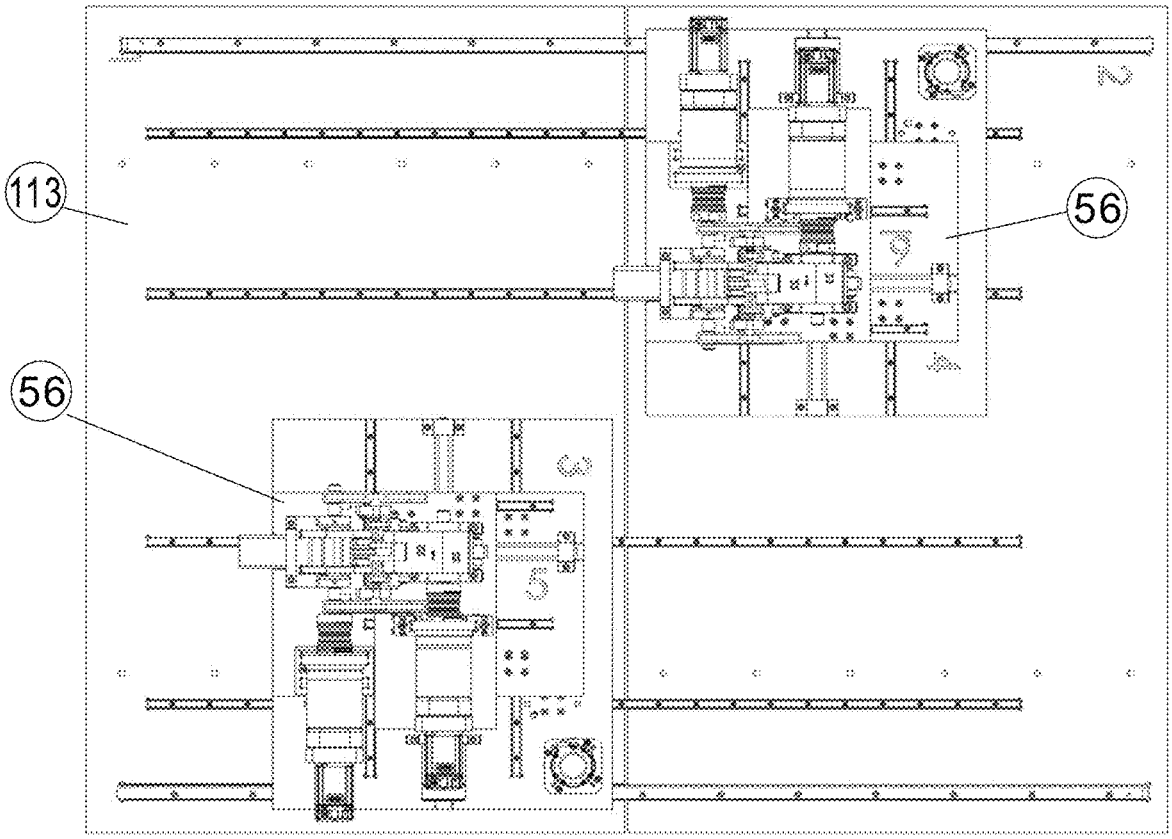
FIG. 14—A top view of the robotic walking mechanism and the carrying module together.
Figure 15:
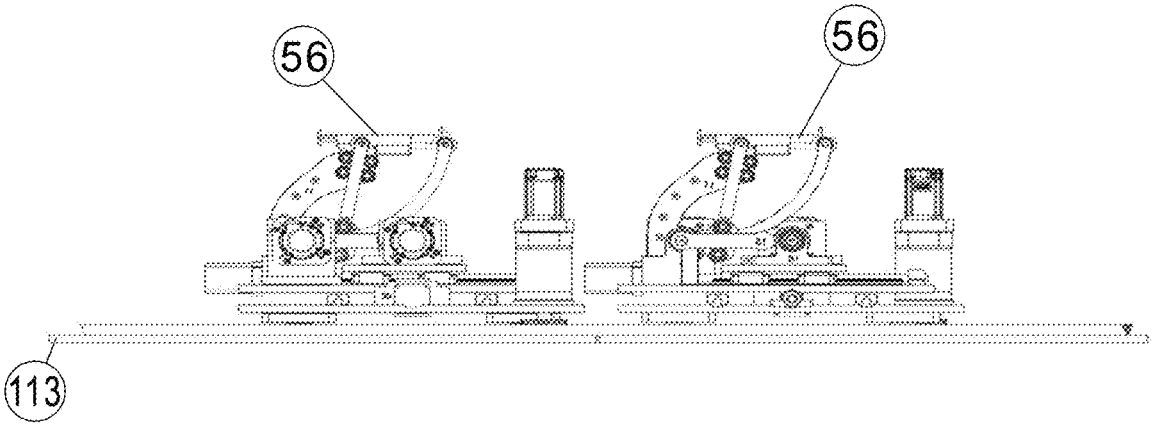
FIG. 15—A side view of the robotic walking mechanism and the carrying module together.
Figure 16:
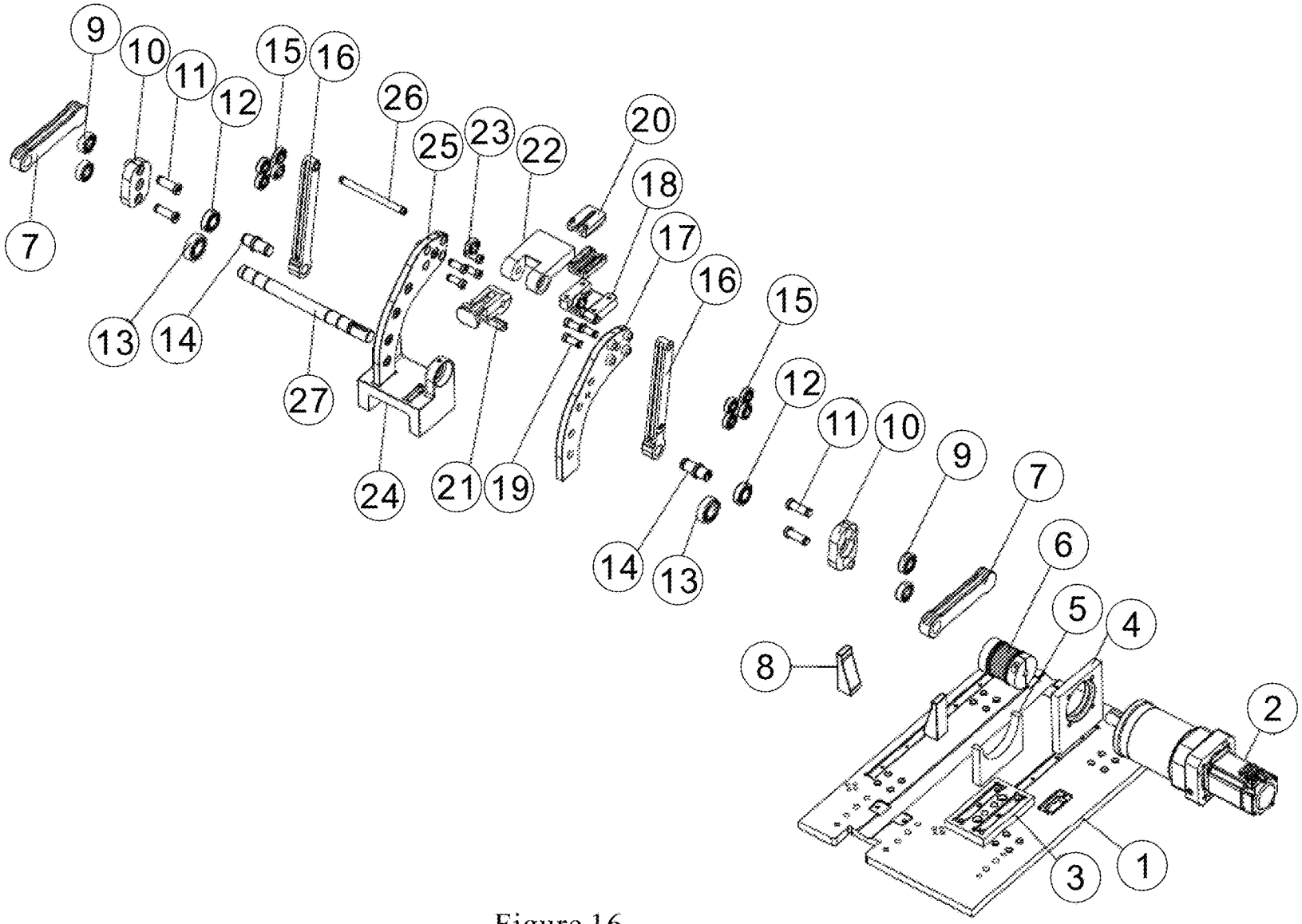
FIG. 16—An exploded view of the forefoot lifting module of the robotic walking mechanism.
Figure 17:
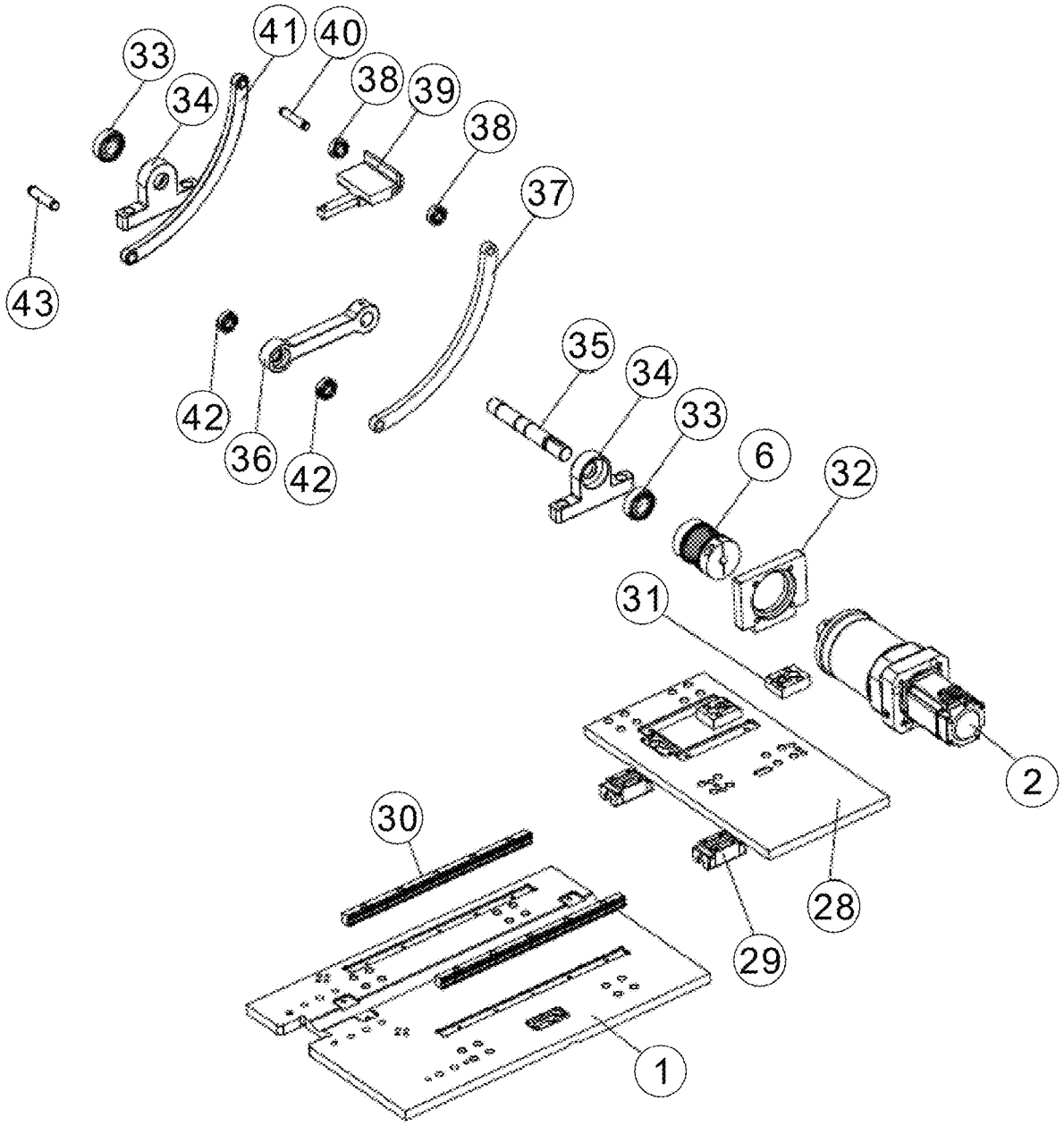
FIG. 17—An exploded view of the heel lifting module of the robotic walking mechanism.
Figure 18:
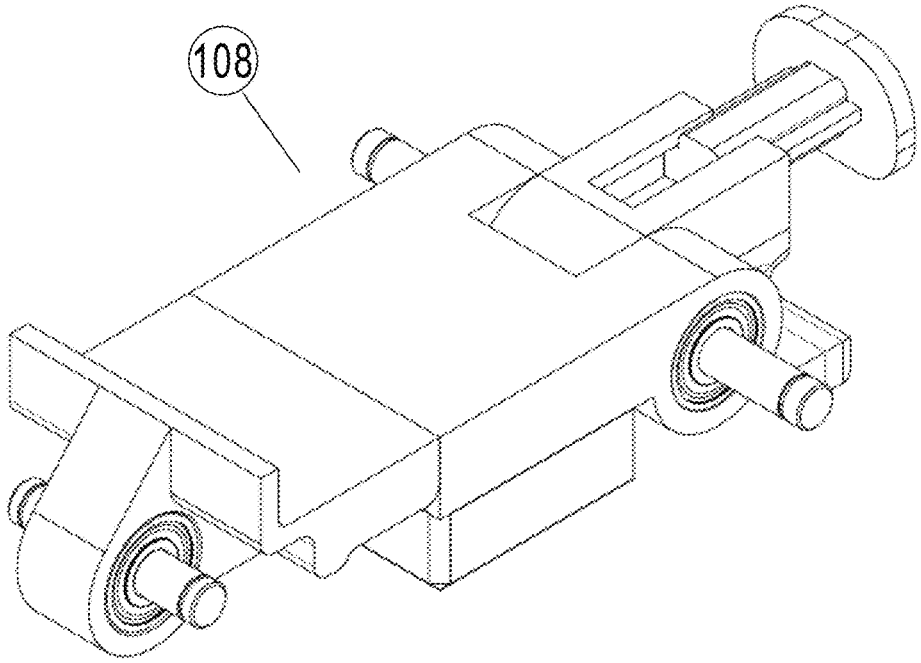
FIG. 18—A general view of the foot mount module.
Figure 19:
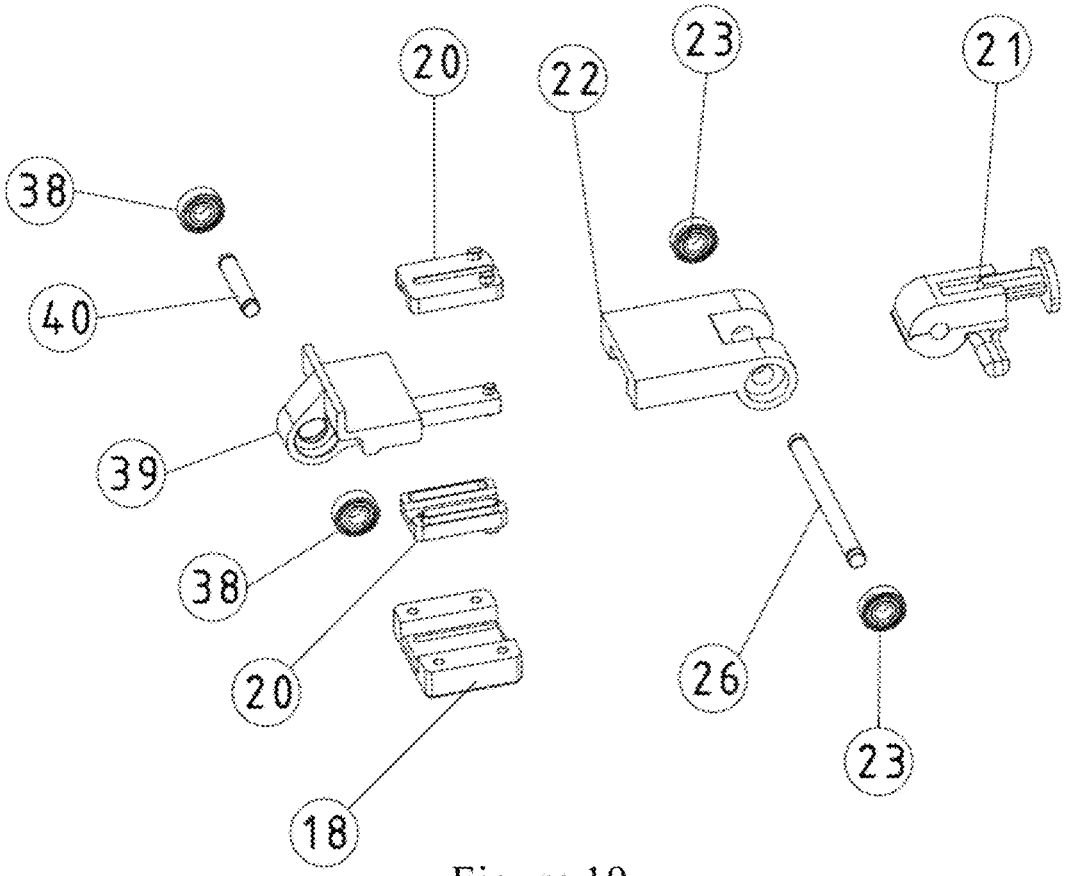
FIG. 19—An exploded view of the foot mount module.

The parts, sections and elements included in the figures are enumerated to provide a better explanation of the locomotion therapy and rehabilitation device developed with this invention and a corresponding definition for each number is provided below.

1. Mounting bracket for forefoot lifting module
2. Electric motor
3. Intermediate link plate for forefoot lifting module
4. Front mounting flange for forefoot lifting
5. Bottom support for forefoot lifting module
6. Reducer outlet coupling
7. Horizontal lifting arm for forefoot lifting module
8. Lower limiting block for horizontal lifting arm for forefoot lifting module
9. Lower connection housing bearing
10. Lower connection housing
11. Mounting pins for lower connection housing bearing
12. Medium bearing for linear lifting arm
13. Large bearing for linear lifting arm
14. Mounting pin for medium bearing for linear lifting arm
15. Small bearing for linear lifting arm
16. Linear lifting arm of forefoot lifting module
17. Left side support for forefoot lifting module
18. Bottom cap for foot mount module
19. Bearing pin for foot mount module
20. Inner socket of foot mount module
21. Toe piece of foot mount module
22. Front base of foot mount module
23. Foot mount module bearing
24. Bottom support connector for forefoot lifting module
25. Right side support for forefoot lifting module
26. Mounting rod for front base for forefoot lifting module
27. Motion shaft of forefoot lifting module
28. Bottom motion plate of heel lifting module
29. Linear carriage of heel lifting module
30. Linear rail of heel lifting module
31. Mounting block of heel lifting module
32. Mounting flange of heel lifting module
33. Housing bearing of heel lifting module
34. Housing of heel lifting module
35. Main motion shaft of heel lifting module
36. Lifting arm of heel lifting module
37. Left lifting profile of heel lifting module
38. Lifting profile bearing of heel lifting module
39. Heel base of heel lifting module
40. Upper shaft of heel lifting module
41. Right lifting profile of heel lifting module
42. Lifting profile bearing of heel lifting module
43. Lower shaft of heel lifting module
44. Robotic walking mechanism main plate
45. Electric motor for lateral movement mechanism of mounting plate for forefoot lifting module
46. Electric motor mounting flange for lateral movement mechanism of mounting plate for forefoot lifting module
47. Slide of lateral movement mechanism of mounting plate for forefoot lifting module
48. Carriage of lateral movement mechanism of mounting plate for forefoot lifting module
49. Threaded rod of lateral movement mechanism of mounting plate for forefoot lifting module
50. Shaft bearing of lateral movement mechanism of mounting plate for forefoot lifting module
51. Horizontal base of locomotion therapy and rehabilitation device
52. Leg support mechanism of locomotion therapy and rehabilitation device
53. Upper body of locomotion therapy and rehabilitation device
54. Weight balancing module of locomotion therapy and rehabilitation device
55. Sling and carrying system of locomotion therapy and rehabilitation device
56. Robotic walking mechanism of locomotion therapy and rehabilitation device
57. Upper intermediate piece of leg support mechanism
58. Leg support piece of leg support mechanism
59. Hip mounting piece of leg support mechanism
60. Front support arm of leg support mechanism
61. Support piston of leg support mechanism
62. Front shaft of leg support mechanism
63. Small shaft of leg support mechanism
64. Left support arm of leg support mechanism
65. Left retainer of leg support mechanism
66. Main mounting piece of leg support mechanism
67. Hinge of leg support mechanism
68. Small flange of leg support mechanism
69. Main shaft of leg support mechanism
70. Bushing of leg support mechanism
71. Large flange of leg support mechanism
72. Lower shaft of leg support mechanism
73. Leg support mechanism motor
74. Threaded rod of leg support mechanism
75. Right support arm of leg support mechanism
76. Right retainer of leg support mechanism
77. Leg support mechanism main plate
78. Rear support arm of leg support mechanism
79. Lower leg support of leg support mechanism
80. Lower leg intermediate piece of leg support mechanism

81. Back support slide
82. Back support
83. Back support slide carriage
84. Upper body profile
86. Back support slide mounting profile
88. Electric motor for back support slide carriage
89. Weight balancing module chassis
90. Weight piece of weight balancing module
91. Threaded rod of weight balancing module
92. Motor mounting apparatus of weight balancing module
93. Hinge base of weight balancing module
94. Lever arm of weight balancing module
95. Main shaft of weight balancing module
96. Orientation motor of weight balancing module
97. Orientation motor connector of weight balancing module
98. Orienting lever of weight balancing module
99. Main electric motor of weight balancing module
100. Weight balancing module connector
101. Large wheel of weight balancing module
102. Small wheel of weight balancing module
103. Carrying module for robotic walking mechanism of locomotion therapy and rehabilitation device
104. Counterweight motion motor of weight balancing module
105. Shaft bearing connector of weight balancing module
106. Orientation bushing of weight balancing module
107. Orientation ring of weight balancing module
108. Foot mount module
109. Linear carriage of robotic walking mechanism
110. Pinion gear of robotic walking mechanism
111. Slides of robotic walking mechanism
112. Rack gear of robotic walking mechanism
113. Carrying module main platform
114. Winding wire

DETAILED DESCRIPTION OF THE INVENTION

The invention according to the application is a locomotion therapy and rehabilitation device developed for patients whose locomotion function is either lost or declined due to spinal disorders, orthopaedic surgeries and central nervous system disorders to redevelop and improve their walking ability.

The invention basically consists of an upper body (53), a weight balancing module (54), a sling and carrying system (55), 2 independent leg support mechanisms (52), 2 independent robotic walking mechanisms (56) and a horizontal base (51) on which all these are fastened.

Upper Body (53):

The height of the upper body (53) is designed in such a manner that it is higher than the sum of the horizontal base's (51) and the patient's heights and it is intended to carry the patient by slinging in order to support a portion of patient's weight.

The upper body (53) is in the form of two vertical towers, which may be prismatic or curved. The relative distance of the towers that constitute the upper body (53) is sufficient to allow position a patient on a wheelchair on the horizontal base (51).

The upper body (53) is fastened onto ground or the horizontal base (51) by means of bolt/nut mounting system.

One back support slide mounting profile (86) is provided for each tower on the uppermost section of the upper body (53) towers. These mounting profiles (86) are fastened onto the upper body (53) towers by means of bolt/nut mounting system and mount the sling and carrying system (55) to the upper body (53).

Sling and Carrying System (55) and Weight Balancing Module (54):

A sling and carrying system (55) that extends above the horizontal base (51) is provided on the top section of the upper body (53).

The sling and carrying system (55) that provides adequate support to patient's back consists of;

- two back supports (82),
- at least two back support slides (81) along which back supports (82) move according to patient's position,
- at least two back support slide carriages (83) that allow back supports' (82) movement on the slides (81), and
- at least one electric motor (88) for back support slide carriages for providing the drive force required to move back supports (82), and the back support slides (81) are fastened onto the mounting profiles' (86) by means of nut/bolt mounting system.

Patient's weight is reduced at a desired rate by means of a weight balancing module (54) which has been specifically designed for this purpose.

The weight balancing module (54);

- a chassis (89) which houses all following components of the weight balancing module (54),
- at least one weight piece (90) to be used as counterweight in order to reduce patient's weight at a desired rate,
- a threaded rod (91) along which the weight piece (90) moves forward-backward,
- a mounting apparatus (92) that connects an electric motor (104) to an lever arm (94),
- two hinge bases (93) that connects a lever arm (94) to a weight balancing module chassis (89),
- a lever arm (94) that moves the weight piece (90),
- a main shaft (95) that connects the lever arm (94) to the hinge bases (93),
- an orienting motor (96) and an orienting lever (98) that allows relative forward-backward movement of a large wheel (101) and a small wheel (102),
- an orientation bushing (106) and an orientation ring (107) that separate the shafts of the main electric motor (99) and the small wheel (102),
- a connector (97) that connects the orienting motor (96) and the orienting lever (98) to each other and also to the chassis (89),
- at least one electric motor (99) that provides drive force required for winding wire on the wheels (101 and 102),
- a connector (100) that the electric motor (99), the large wheel (101), the small wheel (102) to each other and also to the chassis,
- a shaft bearing connector (105) of the weight balancing module,
- a large wheel (101) and a small wheel (102) on which carrier wire is wound which connects the sling apparatus attached to patient's body to the weight balancing module (54).

During simultaneous use of the sling and carrying system (55) and the weight balancing module (55); first, patient should be lifted from the chair into a standing position and then desired rate of weight reduction is applied.

The main problem experienced during this process is to perform weight balancing effectively after patient is quickly moved into vertical position. In principle, after patient is moved into an upright position, the weight piece (90) is slid along the lever arm (94) to reduce patient's weight at a desired rate with the balancing force formed on the opposite end of the lever arm (94). By this means, the carriage wire used to reduce patient's weight during therapy may be extended or retracted without limiting patient's movements. Thus, tensile force on the wire does not change and the system allows quick positioning of patient.

In order to prevent inertia forces that may be caused by the counterweight motion motor's (104) and the motor mounting apparatus' (92) weight during motion, the counterweight motion motor (104) and the motor mounting apparatus (92) are mounted on the rotational axis of the lever arm (94).

Since the electric motor (99) and the small wheel (102) are connected to each other by means of the shaft bearing connector (105) and the orientation bushing (106), the wire attached to the lever arm's (94) end on the electric motor (99) side is connected to the large wheel (101) and the large wheel (101) is located on the connector (100), when the electric motor (99) is operated in the direction where wire is wound on the small wheel (102), until patient is moved into vertical position, patient may stand by means of the sling apparatus which is attached to the end of wire. During this operation, the large wheel (101) is located on the connector (100) and in no contact with the small wheel (102).

After patient is moved into vertical position, counterweight force should be transferred to the wire which lifts patient at a rate equal to the desired weight reduction. For this end, by means of the orienting arm (98) and the orientation motor (96), the large wheel (101) is slid towards the small wheel (102) to lock it therein.

Similarly, the orienting arm (98) slides the orienting bushing (106) with the help of the orienting ring (107) to separate the main motor (99) and the small wheel's (102) shaft, and thereby the connection between the small wheel (102) and the electric motor (99) is severed.

Thus, two wheels join into a single wheel and the lever arm (94) act as a scale pan by means of the wire attached to the large wheel (101) to balance patient's weight during therapy, while the main motor (99) has no effect on the movement.

When patient is being returned to the wheelchair, the orienting arm (98) slides the large wheel (101) in the opposite direction and separates it from the small wheel (102). Meanwhile, the orientation bushing (106) slides in the opposite direction with the help of the orientation ring (107) and locks the small wheel (102) to the main motor (99) shaft, thereby allowing lowering patient down onto the wheelchair with the help of the main motor (99).

The orienting lever (98) and the orientation motor (96) are mounted on the main plate (89) by means of the connector (97).

Leg Support Mechanism (52):

After weight reduction is performed, patient's uncontrolled muscle groups should be balanced during her movements for therapy purposes.

The goal herein is to provide patient a support element to prevent uncontrolled leg movements during therapy caused by patient's lack of movement and control ability.

The leg support mechanism (52) consists of a two-piece upper leg and a two-piece lower leg parts in order to be adjusted according to patient's leg length. Said parts are movable telescopically with the help of a gear or sliding mechanism.

The leg support mechanism (52) is bendable in the knee region and each piece has a connector apparatus for attaching them to legs. By this means full support for legs is provided during walking therapy.

Two leg support mechanisms (52) are present in the system which can be controlled independently. This allows a more effective therapy as movement of patient's each leg is controlled independently. In the prior art rehabilitation devices leg support (52) and back support (82) mechanisms are in the form of a single piece. This prevents independent rehabilitation of patients' legs.

However, in the invention according to the application, each leg is supported independently and the back support (82) may be used independently from the leg support mechanisms (52). This allows patient to learn how to use back and leg muscles more effectively while her posture problem is being corrected.

In order to be adjusted to patient's hip height, the leg support mechanism (52) is positioned by means of two separate lifting mechanisms controlled by a vertically movable rack or helical gear or a belt system.

The leg support mechanisms (52) are connected to this lifting mechanism via horizontally positioned telescopically extending-retracting arms. Thus, the leg support mechanism (52) can be adjusted to the position corresponding to patient's waist and hips.

The leg support mechanism (52) consists of

- a main plate (77) which houses all following components of the leg support mechanism (52),
- at least one motor (73) for providing vertical movement according to patient's waist height, a threaded rod (74) connected to the motor (73), a bushing (70) located on the threaded rod (74),
- a main shaft (69) rotatable axially in the bushing (70),
- a main mounting piece (66) that is housed on the main shaft (69) and connects the rear support arm (78) and the main shaft (69),
- a hinge (67) that is located on the main mounting piece (66), connects the rear support arm (78) and the main mounting piece (66), and allows the rear support arm's (78) upward-downward movement along an axis that is perpendicular to the main mounting piece's (66) rotational axis,
- a small flange (68) and a large flange (71) that fix the main shaft (69) in such a manner that it is axially rotatable in the bushing (70),
- a left retainer (65) and a right retainer (76) that fastens the left support arm (64) and the right support arm (75) onto the main mounting piece (66),
- a lower shaft (72) that connects the left support arm (64) and the right support arm (75) to the support piston (61),
- a small shaft (63) that connects the support piston (61) to the rear support arm (78),
- a support piston (61) that carries the weight of support pieces in line with patient's movements during walking motion and prevents exertion of said weight on patient's body,
- a front support arm (60) to the rear support arm (78) in a telescopically operable manner in order for their length is adjusted according to patient's position,
- a front shaft (62) that is attached to the front support arm (60) to rotate on the front shaft's (62) axis and a hip mounting piece (59),
- an upper leg support piece (58) that supports thigh along the leg on the hip mounting piece (59) and an upper intermediate piece (57) extending telescopically thereon,
- a lower leg intermediate piece (80) attached to the upper intermediate piece (57) and a lower leg support (79) extending telescopically thereon.

Robotic Walking Mechanism (56):

Patient's legs should be actuated in order to teach patient walking motion. For this end, 2 independently movable robotic walking mechanisms (56) are provided in the carrying module (103) which is located in the horizontal base (51).

The robotic walking mechanism (56) is movable forward-backward along the robotic walking mechanism slides (111) with the help of the robotic walking mechanism linear carriages (109). This movement may be actuated by electric motor (2) drive and with the help of a pinion gear (110) and a rack gear (112) connected thereto or by a belt and pulley mechanism connected to the electric motor (2). The rack gear (112) and the robotic walking mechanism slides (111) are mounted onto the lower main platform (113).

This will be used to simulate the forward movement of walking and patient will perform stationary walking.

The robotic walking mechanism (56) is adjustable according to patient's leg length, foot size and stance width. For this end, the foot mount module (108), which consists of an inner socket (20), a toe piece (21) and a front base, is designed as a modular structure in such a manner that it is movable internally to be adjusted to different foot sizes.

The foot mount module (108) is bendable on the line on which metatarsal bones are located in order to make the patient feel the momentum and the grip strength generated in toes while walking. This is crucial for transferring the momentum generated in patient's toes during walking motion to the patient. Toes and forefoot are lifted owing to the upward-downward motion of the linear lifting arms (16) to which they are attached. With the help of this mechanism, patients with various foot sizes can be treated with the device.

The robotic walking mechanism (56) consists of

- a front base (22), a heel base (39) and a toe piece (21) on which patient's foot rests and is fastened by means of straps,
- two linear lifting arms (16) on which the front base (22) is housed with the help of a front base mounting rod (26) and bearings (23),
- a mounting rod (26) that connects the front base (22) and the toe piece (21) and on which the front base (22) rotates around the rod axis,
- a toe piece (21) which is adjustable for different foot sizes with the help of the telescopically extendable piece located on its end,
- a left side support (17) and a right side support (25) for keeping the toe piece (21) parallel to the ground by means of the pins located on the toe piece (21),
- a heel base (39) that moves forward-backward on an inner socket (20) which is linearly movable forward-backward within the bottom cap (18) located under the front base (22),
- an upper shaft (40) and a lifting profile bearing (38) that fasten the heel base (39) to the left lifting profile (37) and the right lifting profile (41),
- a front mounting flange (4) for connecting the electric motor (2) to the butt section of the reducer outlet coupling (6),
- an intermediate link plate (3) for fastening the bottom support (5) and the front mounting flange (4) on the mounting bracket (3),
- a reducer outlet coupling (6) connecting the forefoot lifting module to the motion shaft (27),
- a motion shaft (27) and large bearings (13) for housing the forefoot lifting module on the bottom support connector (24),
- two horizontal lifting arms (7) for fastening the forefoot lifting module to the motion shaft (27),
- bearings (9) and bearing mounting pins (11) that connect the lifting horizontal arms (7) to the lower connection housing (10) and are located inside the groove provided on the arms (7),
- medium bearings (12) and mounting pins (14) that connect the linear lifting arms (16) through the centre of the lower connection housing (10),
- at least 4 small bearings (15) and bearing pins (19) that linearly houses two linear connection arms (16) on right and left sections onto the left side support (17) and the right side support (25) and that are located inside the groove provided on the arms (16),
- a bottom support connector (24) for mounting the left support (17) and the right support (25) on the mounting bracket (1),
- a mounting flange (32) for connecting the electric motor (2) to the butt section of the reducer outlet coupling (6),
- a mounting block (31) for fastening the mounting flange (32) on the bottom motion plate (28),
- at least two linear carriages (29) to which the bottom motion plate (28) is fastened,
- two linear rails (30) on which the linear carriages (29) move,
- two housings (34) and two bearings (33), one on the right and one on the left, for fastening the reducer outlet coupling (65) of the main motion shaft (35) to the bottom motion plate (28) along the shaft's axis,
- a lifting arm (36) fastened on the motion shaft (35),
- a left lifting profile (37) and a right lifting profile (41) connected onto the lifting arm (36) with the help of lifting profile bearings (42) and lifting module lower shaft (43),
- a heel base (39) connected to the left lifting profile (37) and the right lifting profile (41) with the help of the upper shaft (40) and the lifting profile bearings (38),
- a left side support (17) and a right side support (25) located on the mounting bracket (1),
- Carriages (48) that connect the mounting bracket (1) to the main plate (44) and slides (47) accommodating the carriages (48),
- an electric motor mounting flange (46), a shaft bearing (50), a threaded rod (49), and an electric motor (45) that control the mounting bracket's (1) motion on the main plate (44).

Figure 20:
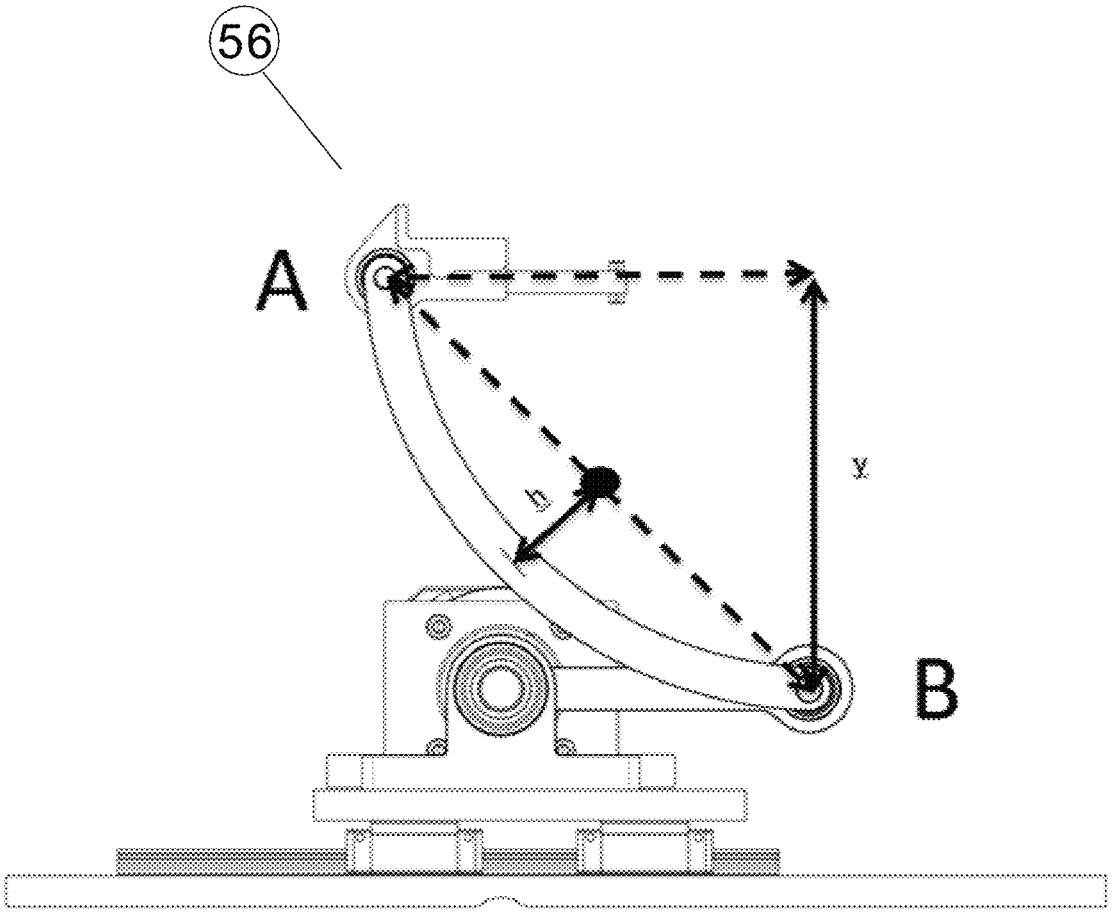
FIG. 20—A dimensional view of the heel lifting module of the robotic walking mechanism.
Figure 21:
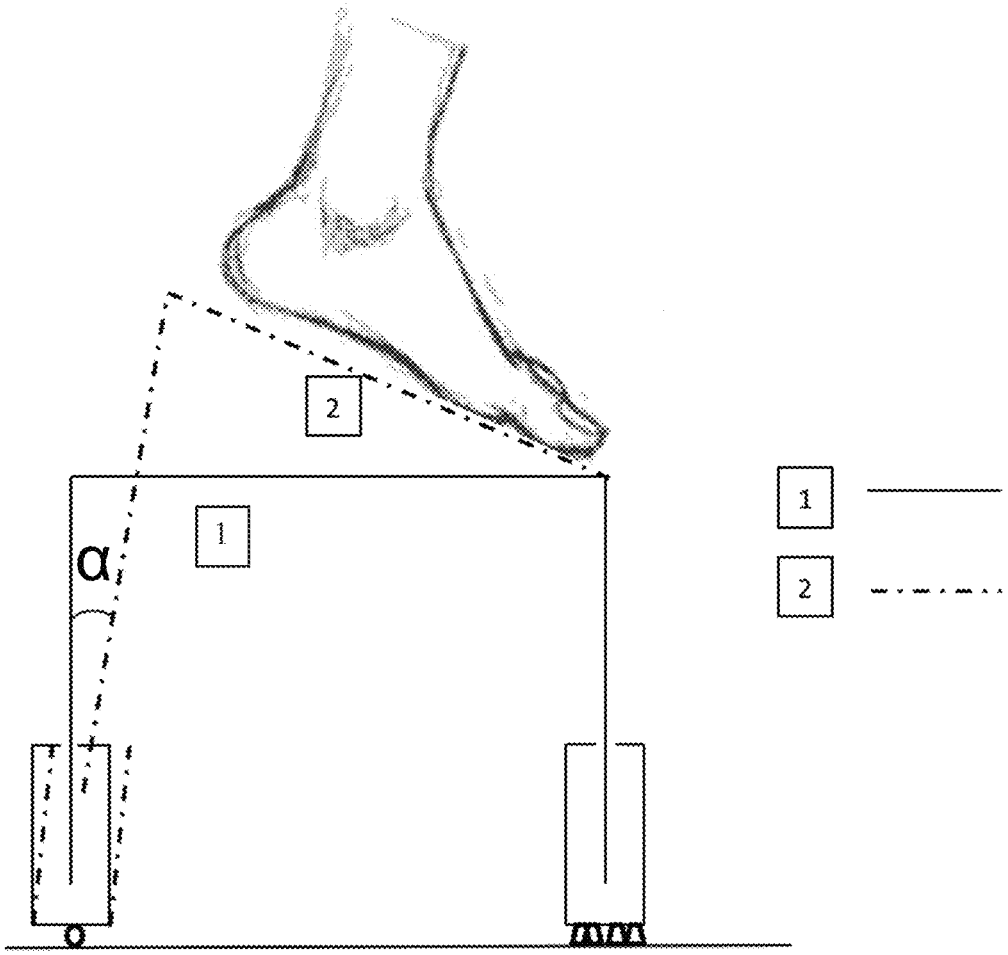
Figure 21(Prior art)
FIG. 21—A representation showing the working mechanism of the Jungwon Yoon's invention.

The heel lifting module's dimensions may be seen in FIG. 20, as the perpendicular distance from the AB line of the left lifting profile (37) and the right lifting profile (41) to the centre of [AB] of which this line is the chord should be h=0-200 mm and the height of the profiles (37 and 41) from their lower and higher ends should be y=100-700 mm.

While the forefoot lifting module may be connected to the motion shaft (27) by means of a reducer outlet coupling (6), it may also be connected with a belt and pulley mechanism.

Additionally, all parts connected to the electric motors included in the locomotion therapy and rehabilitation device according to the invention may be connected to the electric motors by means of couplings or a belt and pulley mechanism.

The motion mechanism of the forefoot lifting module of the robotic walking mechanism (56) operates as explained below.

While the horizontal lifting arm (7) rotates on the axis of the forefoot lifting module's motion shaft (27), the lower connection housing bearing (9) moves forward-backward along the grooves provided on the horizontal lifting arm (7)

to rotate on the axis of the mounting pin for medium bearing for linear lifting arm (14) of the lower connection bearing (10), thereby moves the linear lifting arm of the forefoot lifting module (16) upwards-downwards.

With this mechanism, the locomotion therapy and rehabilitation device according to the invention is able to simulate all motions of a foot during stepping in a normal walking movement.

The invention claimed is:

1. A locomotion therapy and rehabilitation device, developed for a patient whose locomotion function is either lost or declined due to spinal disorders, orthopaedic surgeries or central nervous system disorders to redevelop and improve the patient's walking ability, comprising:

an upper body in a form of two vertical towers, which allows carrying the patient by slinging in order to support a portion of patient's weight; a sling and carrying system;

a back support slide mounting profile per tower which connects the sling and carrying system to the upper body at a top section of upper body towers;

a weight balancing module that reduces the patient's weight at a predefined rate and is positioned in a chassis, comprising, at least one weight piece to be used as a counterweight in order to reduce the patient's weight at the predefined rate, a first threaded rod along which the at least one weight piece is configured to move forward and backward, a lever arm configured to move the at least one weight piece, a mounting apparatus that connects a first electric motor to the lever arm, two hinge bases that connect the lever arm to the chassis, a first main shaft that connects the lever arm to the two hinge bases, an orienting motor and an orienting lever that allow a relative forward and backward movement of a large wheel and a small wheel, at least one main electric motor to a winding wire on the large wheel and the small wheel, an orientation bushing and an orientation ring that separate shafts of the at least one main electric motor and the small wheel, a first connector that connects the orienting motor and the orienting lever to each other and also to the chassis of the weight balancing module, the at least one main electric motor, the large wheel, and the small wheel are connected to each other and also to the chassis of the weight balancing module, a shaft bearing connector of the weight balancing module, wherein the large wheel and the small wheel on which a carrier wire is wound which connects a sling apparatus attached to the patient's body to the weight balancing module, the sling and carrying system comprising, two back supports, at least two back support slides along which the back supports move according to the patient's position, at least two back support slide carriages that allow a movement of the back supports on the back support slides, and at least one second electric motor for the at least two back support slide carriages for providing a drive force required to move the two back supports, two independent leg support mechanisms including a two-piece upper leg and a two-piece lower leg part in order to balance uncontrolled leg movements during the patient's therapy oriented movements, bendable in a knee region, controllable independently, positioned with two separated lifting mechanisms controlled by a vertically moving rack or a helical gear or a belt system, comprising, a main plate, at least one motor for providing a vertical movement according to the patient's waist height, a second threaded rod connected to the at least one motor for providing the vertical movement according to the patient's waist height, a bushing located on the second threaded rod connected to the motor for providing the vertical movement according to the patient's waist height, a second main shaft rotatable axially in the bushing, a main mounting piece that is housed on the second main shaft and connects a rear support arm and the second main shaft, a hinge that is located on the main mounting piece, connects the rear support arm and the main mounting piece, and allows a upward and downward movement of the rear support arm along an axis that is perpendicular to the main mounting piece's rotational axis, a small flange and a large flange that fix the second main shaft in a manner so that the second main shaft is axially rotatable in the bushing, a left retainer and a right retainer that fasten a left support arm and a right support arm onto the main mounting piece, a lower shaft that connects the left support arm and the right support arm to a support piston, a small shaft that connects the support piston to the rear support arm, the support piston that carries weights of support pieces in line with the patient's movements during a walking motion and prevents an exertion of the weights on the patient's body, a front support arm that connects to the rear support arm in a telescopically operable manner, a front shaft that is attached to the front support arm to rotate on an axis of the front shaft and a hip mounting piece, an upper leg support piece and an upper intermediate piece extending telescopically thereon the upper leg support piece, a lower leg intermediate piece attached to the upper intermediate piece and a lower leg support extending telescopically thereon, two independent walking mechanisms that are provided in a carrying module which is located in the horizontal base in order to actuate the patient's legs to teach the patient the walking motion, independently movable, in order to make the patient feel a momentum and a grip strength generated in toes while walking, able to lift the toes and a forefoot owing to an upward and downward motion of linear lifting arms to which the walking mechanisms are attached, comprising, a front base, which is configured to be fastened to a patient's foot by means of a plurality of straps, two linear lifting arms on which the front base is attached with the help of a front base mounting rod and a plurality of first bearings, a toe piece which is adjustable for different foot sizes with the help of a telescopically extendable piece located at an end of the toe piece, a mounting rod that connects the front base and the toe piece and wherein the front base rotates around an axis of the mounting rod on the mounting rod, a left side support and a right side support for keeping the toe piece parallel to ground by means of a plurality of pins located on the toe piece, a heel base that moves forward and backward on an inner socket which is linearly movable forward and backward within a bottom cap located under the front base, an upper shaft and a lifting profile bearing that fasten the heel base to a left lifting profile and a right lifting profile, a motion shaft and large bearings for housing a forefoot lifting module on the bottom support connector, a reducer outlet coupling connecting the forefoot lifting module to the motion shaft, a front mounting flange for connecting a third electric motor to the reducer outlet coupling, an intermediate link plate for fastening a bottom support and the front mounting flange on a mounting bracket, two horizontal lifting arms for fastening the forefoot lifting module to the motion shaft, a plurality of lower connection housing bearings and a plurality of bearing mounting pins that connect the two horizontal lifting arms to the lower connection housing and are located inside a groove provided on the arms, a plurality of medium bearings and a plurality of mounting pins that connect the two linear lifting arms through a centre of the lower connection housing, at least four small bearings and a plurality of bearing pins that linearly hold the two linear lifting arms on right and left sections onto the left side support and the right side support and that are located inside the groove provided on the two linear lifting arms, a bottom support connector for mounting the left side support and the right side support on the mounting bracket, a mounting flange for connecting the third electric motor to the reducer outlet coupling, a mounting block for fastening the mounting flange on a bottom motion plate, at least two linear carriages to which the bottom motion plate is fastened, two linear rails on which the at least two linear carriages move, two housings and two housing bearings of heel lifting module, one housing of the two housings and one housing bearing of the two housing bearings of heel lifting module located on a right side while an other housing of the two housings and an other housing bearing of the two housing bearings of heel lifting module located on a left side, to fasten the reducer outlet coupling of a main motion shaft to the bottom motion plate along an axis of the main motion shaft, a lifting arm fastened on the main motion shaft, the left lifting profile and the right lifting profile connected onto the lifting arm with the help of the lifting profile bearing and a lifting module lower shaft, the heel base connected to the left lifting profile and the right lifting profile with the help of the upper shaft and the lifting profile bearing, a left side support and a right side support located on the mounting bracket, a plurality of carriages that connect the mounting bracket to the main plate and a plurality of slides accommodating the plurality of carriages, an electric motor mounting flange, a shaft bearing, a third threaded rod, and a fourth electric motor that control motions of the mounting bracket on the main plate.

2. The locomotion therapy and rehabilitation device according to claim 1, wherein a height of the upper body is higher than a sum of a height of the horizontal base and a height of the patient.

3. The locomotion therapy and rehabilitation device according to claim 1, wherein the upper body is prismatic or curved.

4. The locomotion therapy and rehabilitation device according to claim 1, wherein a relative distance of the two vertical towers that constitute the upper body is sufficient to allow positioning the patient on a wheelchair on the horizontal base.

5. The locomotion therapy and rehabilitation device according to claim 1, wherein the upper body is fastened onto the ground or the horizontal base by means of a bolt/nut mounting system.

6. The locomotion therapy and rehabilitation device according to claim 1, wherein the back support slide mounting profile is fastened onto the two vertical towers of the upper body by means of a bolt/nut mounting system.

7. The locomotion therapy and rehabilitation device according to claim 1, wherein the at least two back support slides are fastened onto the back support slide mounting profile by means of a nut/bolt mounting system.

8. The locomotion therapy and rehabilitation device according to claim 1, wherein a counterweight motion motor and the motor mounting apparatus are mounted along a rotational axis of the lever arm in order to prevent inertia forces that are caused by a weight of the counterweight motion motor and weights of the motor mounting apparatus during a motion.

9. The locomotion therapy and rehabilitation device according to claim 1, wherein the at least one main electric motor and the small wheel are connected to each other by means of the shaft bearing connector and the orientation bushing.

10. The locomotion therapy and rehabilitation device according to claim 1, herein a wire attached to an end of the lever arm on a side of the at least one main electric motor is connected to the large wheel.

11. The locomotion orienting lever therapy and rehabilitation device according to claim 1, wherein the orienting lever and an orientation motor are mounted on the main plate by means of the first connector.

12. The locomotion therapy and rehabilitation device according to claim 1, wherein the two-piece upper leg and the two-piece lower leg part of the leg support mechanisms are movable telescopically with the help of a gear or sliding mechanism.

13. The locomotion therapy and rehabilitation device according to claim 1, wherein the two back supports are used independently from the leg support mechanisms.

14. The locomotion therapy and rehabilitation device according to claim 1, wherein the leg support mechanisms are connected to the two separate lifting mechanisms via horizontally positioned telescopically extending-retracting arms.

15. The locomotion therapy and rehabilitation device according to claim 1, wherein the two independent walking mechanisms are movable forward and backward along robotic walking mechanism slides with the help of robotic walking mechanism linear carriages.

16. The locomotion therapy and rehabilitation device according to claim 1, wherein movements of the two independent walking mechanisms are actuated by the third electric motor driven via a pinion gear and a rack gear connected to the third electric motor.

17. The locomotion therapy and rehabilitation device according to claim 1, wherein the movements of the two independent walking mechanisms are actuated by a belt and pulley mechanism connected to electric motors.

18. The locomotion therapy and rehabilitation device according to claim 1, wherein the rack gear and the robotic walking mechanism slides are mounted onto a lower main platform.

19. The locomotion therapy and rehabilitation device according to claim 1, wherein the two independent walking mechanisms are adjustable according to the patient's leg length, foot size and stance width.

20. The locomotion therapy and rehabilitation device according to claim 1, wherein a foot mount module, which consists of an inner socket, the toe piece and the front base, is a modular structure so that the foot mount module is movable internally to be adjusted to different foot sizes.

21. The locomotion therapy and rehabilitation device according to claim 1, wherein the toe piece is adjustable for different foot sizes with the help of the telescopically extendable piece located on the end of the toe piece.

22. The locomotion therapy and rehabilitation device according to claim 1, wherein the heel base is fastened to the left lifting profile and the right lifting profile with the help of the upper shaft and the lifting profile bearing.

23. The locomotion therapy and rehabilitation device according to claim 1, wherein the perpendicular distance from a AB line of the left lifting profile and the right lifting profile to a centre of the AB line, wherein the AB line is the chord and is 0-200 mm.

24. The locomotion therapy and rehabilitation device according to claim 1, wherein the heights of the left lifting profile and the right lifting profile from a lower end of the left lifting profile and the right lifting profile to a higher end of the left lifting profile and the right lifting profile are 100-700 mm.

25. The locomotion therapy and rehabilitation device according to claim 1, wherein the forefoot lifting module is connected to a motion shaft by means of a belt and pulley mechanism.

26. The locomotion therapy and rehabilitation device according to claim 1, wherein, after the patient is moved into a vertical position, the at least one weight piece is configured to slide on the lever arm.

27. The locomotion therapy and rehabilitation device according to claim 1, wherein the at least one main electric motor is configured to operate in a direction where the winding wire is wound on the small wheel, until the patient is moved into a vertical position.

28. The locomotion therapy and rehabilitation device according to claim 1, wherein the sling apparatus which is attached to an end of the carrier wire is configured to lift the patient to stand.

29. The locomotion therapy and rehabilitation device according to claim 1, wherein, the large wheel is configured to be in no contact with the small wheel while the patient is being lifted.

30. The locomotion therapy and rehabilitation device according to claim 1, wherein, after the patient is moved into a vertical position, in order to transfer a counterweight force to a wire which lifts the patient at a rate equal to a predefined weight reduction, the large wheel is configured to slide towards the small wheel to lock the small wheel by means of an orienting arm and the orientation motor.

31. The locomotion therapy and rehabilitation device according to claim 1, wherein, in order to balance patient's weight during the therapy, the orienting arm is configured to slide the orienting bushing with the help of an orienting ring to separate the at least one main motor and the small wheel's shaft, and thereby severe a connection between the small wheel and the at least one main electric motor; two wheels are configured to join into a single wheel and the lever arm is configured to act as a scale pan by means of a wire attached to the large wheel to ensure that the patient's weight has no effect on the at least one main motor during the therapy.

32. The locomotion therapy and rehabilitation device according to claim 1, wherein, in order to return the patient to a wheelchair, the orienting arm is configured to slide the large wheel in an opposite direction and separate the large wheel from the small wheel as the orientation bushing slides in an opposite direction with the help of the orientation ring and locks the small wheel to a shaft of the at least one main motor.

33. The locomotion therapy and rehabilitation device according to claim 1, wherein while the two horizontal lifting arms rotate on an axis of the motion shaft of the forefoot lifting module, the lower connection housing bearings are configured to move forward and backward along grooves provided on the two horizontal lifting arms to rotate on an axis of the mounting pins for the medium bearings for the two linear lifting arms of a lower connection bearing, thereby moves the two linear lifting arms of the forefoot lifting module upwards and downwards.

* * * * *